US005367709A

United States Patent [19]

Teasley

[11] Patent Number: 5,367,709

[45] Date of Patent: Nov. 29, 1994

[54] ADJUSTABLE CLOTHING FOR INFANTS

[76] Inventor: Nancy A. Teasley, 1124 Devenger Rd., Greer, S.C. 29650

[21] Appl. No.: 88,893

[22] Filed: Jul. 8, 1993

[51] Int. Cl.[5] ..... A41D 11/00

[52] U.S. Cl. ..... 2/69; 2/75; 2/83

[58] Field of Search ..... 2/69, 69.5, 76, 79, 2/221, 237, 105, 106, 75, 80, 217, 218, 83

[56] References Cited

U.S. PATENT DOCUMENTS

| | | | |
|---|---|---|---|
| 416,022 | 11/1889 | Way | 2/217 |
| 645,488 | 3/1900 | Osgood | 2/80 X |
| 709,862 | 9/1902 | Baughman | 2/117 |
| 2,469,246 | 5/1949 | Smicker | 2/111 |
| 2,437,989 | 3/1948 | Artzt et al. | 2/113 |
| 2,502,314 | 3/1950 | Donin | 2/106 |
| 2,687,530 | 8/1954 | Farnum | 2/217 |
| 4,773,101 | 9/1988 | Kapp et al. | 2/69.5 |
| 5,206,957 | 5/1993 | Gulick | 2/69 X |

*Primary Examiner*—Jeanette E. Chapman
*Attorney, Agent, or Firm*—Hardaway Law Firm

[57] ABSTRACT

An adjustable garment having a length adjustment feature provided by a pair of drawstrings positioned along either side of the garment, the drawstrings permitting uniform gathering of the garment material along either side of the garment, thereby shortening the length of the garment.

4 Claims, 1 Drawing Sheet

FIG. 1
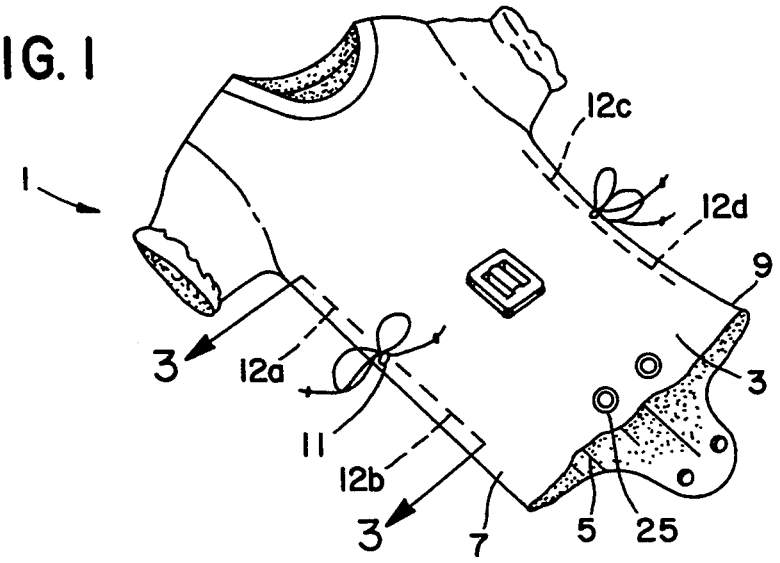
FIG. 2
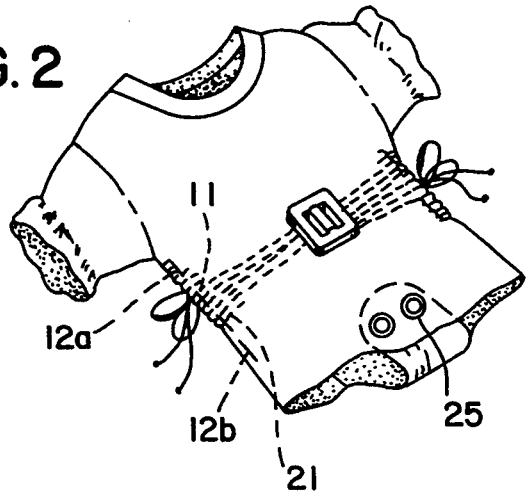
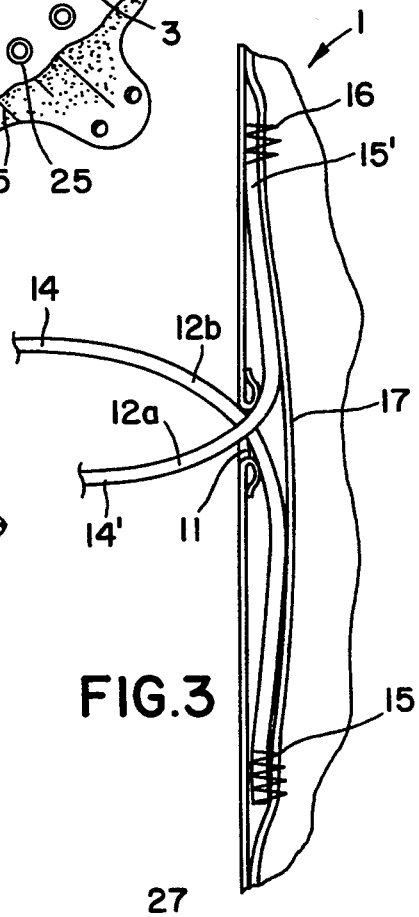
FIG. 3
FIG. 4
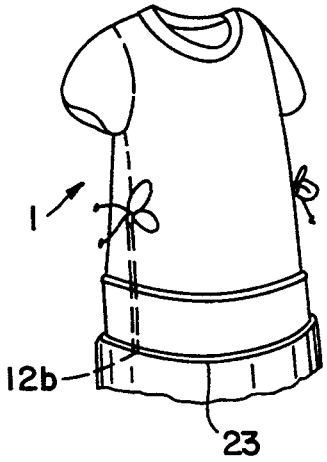
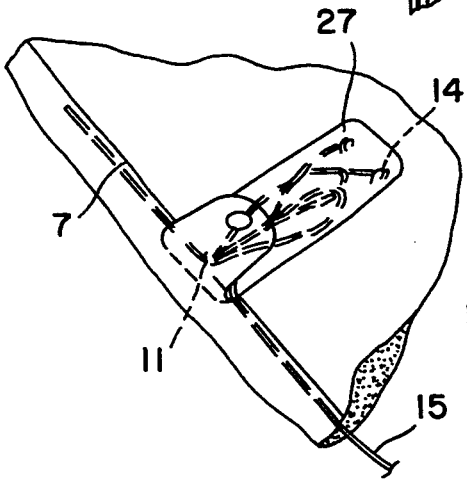
FIG. 5

ADJUSTABLE CLOTHING FOR INFANTS

BACKGROUND OF THE INVENTION

The present invention relates generally to adjustable clothing for infants and toddlers that reversibly adjusts in length to accommodate the growth of a child.

Clothing for infants and toddlers will typically be worn by a child for a brief period of time. Children in this age range grow and develop so rapidly that a given outfit is quickly outgrown. This is especially true for seasonal clothing which typically cannot be used by the same child the following season.

Further, the purchase of children's clothing is a frustrating experience in that young children's clothes are usually classified by a child's age. However, there is enormous variation among children of any given age in their size and proportions. Adjustable clothing which can be easily adjusted to fit a wide age of varying sized children is an improvement over traditional infant and toddler apparel sizing.

A variety of means for adjusting clothing has been developed. U.S. Pat. No. 2,714,718 to Kramer teaches an adjustable garment in which the length and girth are separately adjustable through the use of numerous overlapping buttons in proximity to a button hole.

U.S. Pat. No. 2,831,194 to Hunczak provides an adjustable slip. Length adjustments to the slip are provided by four pairs of drawstrings aligned with shoulder straps to adjust the fit of the slip.

U.S. Pat. No. 4,774,725 to Garrett provides hook and eye attachments to provide an adjustable length overskirt.

U.S. Pat. No. 5,170,505 to Rohrer provides for an adjustable child outfit which uses a plurality of loop and hook fasteners to adjust various panels of clothing.

However, the prior art clothing lacks simple adjustment features and fails to provide a garment which maintains an aesthetically pleasing appearance as the garment is modified.

SUMMARY OF THE INVENTION

It is thus an object of the present invention to provide a garment whose length is easily adjustable to accommodate growth changes in children.

It is a further object of this invention to provide an adjustable length garment which facilitates the sizing of infant's and toddler's clothing.

It is a further and more particular object of this invention to provide a romper outfit which maintains the garment's integrity while providing length adjustments spanning several sizes.

It is yet a further object of this invention to provide a garment with length adjusting means attached to seams along either side of the garment.

It is still a further and more particular object of this invention to provide a tube-knitted garment with reversible length adjusting means.

These as well as other objects of this invention are provided by a garment having a front, a back, a first side and a second side; a first adjusting means secured to the first garment side, the first adjusting means reversibly gathering a portion of the front and a portion of the back garment in a lengthwise fashion in proximity to the first adjusting means; a second adjusting means secured to the second garment side, the second adjusting means reversibly gathering the garment front and the garment back in a lengthwise fashion in proximity to the garment adjusting means; wherein the first and the second adjusting means are used to adjust the relative length of the garment.

BRIEF DESCRIPTION OF THE DRAWINGS

FIG. 1 of the drawings is a perspective view in partial section of an embodiment of a garment constructed according to this invention.

FIG. 2 of the drawings is a perspective view in partial section of the garment in FIG. 1 with the adjusting means fully engaged.

FIG. 3 of the drawings is a sectional view taken along line 1—1 showing details of the adjusting means.

FIG. 4 of the drawings is an additional embodiment of the present invention.

FIG. 5 of the drawings is a view in partial section of an additional embodiment of the present invention.

DETAILED DESCRIPTION

In accordance with this invention, it is seen that a garment is provided whose length is easily and reversibly adjustable, the adjusting means permitting a single garment to be used over several traditional clothing sizes.

As best seen and understood in reference to the accompanying figures, a preferred embodiment of the present garment is described. As seen in FIG. 1, garment 1 is a romper outfit having a front panel 3, a back panel 5, a first side seam 7 and a second side seam 9, seams 7 and 9 connecting the front and back panels. Along the approximate mid-point of seams 7 and 9, a button hole 11 or similar aperture is provided. Aperture 11 permits communication between the exterior of the garment and the interior portion of the garment by the length adjusting means seen as drawstring pairs **12*a*–12*b*, and 12*c*–12*d***.

As best seen in reference to FIG. 3, a single pair of drawstrings **12*a* and 12*b* are illustrated seen in relation to seam 7 with portions of the garment seen in section for clarity. Drawstrings 12*a* and 12*b* and drawstrings 12*c* and 12*d* (not pictured) have a free end 14 and 14' on the exterior of the garment. The respective drawstrings pass through aperture 11 and travel along an inner portion of garment 1. The fixed or first end 15 and 15' of each drawstring is attached by threads 16 to a portion of seam 7 or other portions of the garment such that the interior length of each drawstring runs essentially parallel along the common length of the respective seam, free end 14 and 14' passing through aperture 11 to the exterior of garment 1. The aperture is positioned at an approximate midpoint between the fixed or first drawstring ends 15 and 15'. Alternatively stated, one of each pair of drawstrings 12*a* and 12*c* has an interior portion which are positioned above said aperture 11, while the other of each pair of drawstrings 12*b* and 12*d*** also having an interior portion are positioned below said aperture. The interior portion of each drawstring is substantially parallel to each garment side.

The interior portion of each drawstring is housed within a sleeve 17, sleeve 17 sewn along its edges to the interior of the associated seam. Sleeve 17 is provided by a flat panel of fabric which is secured along the fabric edges against the interior of the associated seam, therefore providing a sleeve for retaining the interior portion of the drawstring. However, a separate casing which houses the drawstring can also be employed.

A portion of drawstrings 12*a* and 12*b* are thereby retained in sleeve 17, the sleeve increasing the comfort of the garment and reducing the risk of entanglement. Sleeve 17 also facilitates the uniform gathering of garment material once the drawstrings are engaged.

Each pair of drawstrings, i.e., 12*a*–12*b* , and 12*c*–12*d* are oppositely running and are used to control the garment length. Each drawstring pair is engaged as are the strings of a shoe. As seen in FIG. 2, as the drawstrings are tightened, a portion of the interior drawstring is withdrawn through aperture 11 to the garment's exterior. This results in a shortening of the garment length as the garment fabric is gathered in a plurality of folds 21 above and below buttonhole 11. The length of the adjusting means associated with the sleeve/seam interface can be varied, thereby controlling the maximum length of adjustments provided by a garment. By engaging the drawstrings as described above, the effective length of a garment is decreased, permitting the garment to fit a smaller child than the ungathered garment seen in FIG. 1.

The present invention is ideally suited for romper type outfits. Infant's and toddler's romper suits are attractive in a loose fitting style. Pre-toddler age children are less mobile, therefore the loose fit of the gathered romper outfit does not impair the child's mobility. As the child grows and matures, the garment length can be increased accordingly, the garment eventually assuming the full, ungathered proportions seen in FIG. 1. The gathered edges and ruffles associated with the length adjustments means of the present invention are attractive and ornamental features suitable for children that size. Further, romper outfits are well suited for the described length adjustment means in that the front and rear portions of the garment have reversible fastening means 25, such as snaps, about the crotch and legs of the wearer. As a result, the length adjusting means along the sides of the garment proportionally affect the garment length of the inner leg and diaper portion of the garment to provide the necessary overall length change for an attractive and functional garment appearance.

The present invention is applicable to a variety of different clothing styles as well. It has been found that dresses, sleepers and one-piece shirts ("onesies") are suitable for use in accordance with the present invention.

A dress or skirt can be provided with a circular hoop, ruffle, or other stiffening means 23 which is in communication with the length adjusting means. As the length adjusting means are engaged along either side of the garment, the stiffening means helps transmit a length change to the entire circumference of the garment.

As best seen in FIG. 4, stiffening means 23 are provided by a series of pre-defined ruffles or circumferential pleats which facilitate the accompanying accordion-like increases or decreases in the gathered fabric. Other types of clothing do not require the stiffening means. For instance, one-piece footed pajamas can be provided having the length adjusting means located along either side seam of the garment. When the length adjusting means are fully engaged, regions around the inner thigh and crotch may have a looser, more open fit. The garment is fully functional with the loose fit. However, it may be preferable to provide a ruffled appearance or design about the loose fit area or provide a series of pre-defined folds or pleats which can be adjustably snapped or secured in place to take up any excess fabric.

To increase the fit and appearance of the garments constructed according to the present invention, it has been found useful to provide an elastic gather along the back of the garment so as to better define the waist region of the garment. The elastic gather not only improves the appearance of the outfit, but accommodates normal increases in girth as the child's size increases.

While a preferred embodiment of the length adjusting means comprises drawstrings, other equivalent means of providing length adjustment are possible. For example, elastic or elastic material can be used in place of the drawstrings. The elastic length adjusting means can either be tied in the desired position, snapped together, secured with loop and hook fasteners or other well know fastening means.

Other length adjusting means would include fabric strips used as drawstrings, ribbons or ornamental pieces of fabric which may compliment an exterior garment design. While the preferred embodiment places the length adjusting means along the interior of the garment, it is understood that the length adjusting means would function equally well whether present on the garment interior, the garment exterior or when positioned between multiple layers of a garment. Similarly, seamless outfits such as tube knitted garments are fully functional with side positioned length adjusting means.

If desired, an external pocket or sealable flap 27 (FIG. 5) can be provided adjacent to the length adjusting means in which the free ends of the length adjusting means can be secured. This feature would prevent the child or a playmate from playing with the length adjusting means. Alternatively, a pocket or flap on the interior of the garment could function in a similar manner which would not require any external exposure of the length adjusting means. However, such an arrangement is not preferred and is more difficult to engage the length adjusting means and would be cumbersome to adjust when a child is wearing the outfit.

The preferred embodiment of the present invention permits length adjusting means to be easily engaged and varied while the garment being worn. For children one or two traditional sizes apart, the same outfit can be used interchangeably, thereby extending the wardrobe selection for closely sized children.

It is thus seen that in accordance with this invention, a garment is provided which provides an easily adjusted length which permits the outfit to be lengthened as the child grows. As variations will become apparent to those of skill in the art from a reading of the above description, such variations are embodied within the spirit and scope of the invention as defined by the following appended claims.

That which is claimed:

1. An adjustable garment comprising:

a front panel and a back panel, said front panel attached to said back panel along a first side seam and a second side seam;

a first adjusting means having a first drawstring and a second drawstring, said first drawstring attached at a first end to said side seam, said second drawstring attached at a first end to said side seam at a spaced distance from said first drawstring end; an aperture in proximity to said first side seam, said aperture positioned at an approximate midpoint between said first drawstring ends, a portion of said first and said second drawstring further positioned along said first side seam, a free end of said first drawstring and a free end of said second drawstring in communication with said aperture, said first drawstring and said second drawstring permitting the reversible gathering of said first panel and said second panel in a lengthwise fashion in proximity to said first aperture;

a second adjusting means having a first drawstring and a second drawstring, said first drawstring attached at a first end to said second side seam, said second drawstring attached at a first end to said second side seam at a spaced distance from said first drawstring, an aperture in proximity to said second side seam, said aperture positioned at an approximate midpoint between said first drawstring and said second drawstring end, a portion of said first and said second drawstring each further positioned along said first side seam, a free end of said first drawstring and a free end of said second drawstring in communication with said aperture, said first drawstring and said second drawstring permit the reversible gathering of said front panel and said back panel in a lengthwise fashion in proximity to said second aperture;

wherein said first adjustment means and said second adjustment means are used to vary the length of said garment.

2. An adjustable garment comprising:

a front, a back, a first side and a second side;

a first adjusting means comprising an aperture defined by a first side of said garment;

a first drawstring in communication with said aperture having an interior portion positioned above said aperture, said interior portion substantially parallel to said first garment side; and a second drawstring in communication with said aperture having an interior portion positioned below said aperture and substantially parallel to said first garment side;

a second adjusting means comprising an aperture defined by a second side of said garment;

a first drawstring in communication with said aperture having an interior portion positioned above said aperture and substantially parallel to said second garment side; and a second drawstring in communication with said aperture having an interior portion positioned below said aperture and substantially parallel to said second garment side;

wherein said first adjusting means and said second adjusting means are used to vary the length of said garment.

3. An adjustable garment comprising a front, a back, a first side and a second side;

a first adjusting means further comprising a pair of oppositely running drawstrings attached at their respective ends to said first garment side, a free end of said drawstring pairs in communication with an aperture defined by said garment along said first garment side at an approximate midpoint between said attached ends of said drawstring pairs, said first adjusting means reversibly gathering said garment front and said garment rear in a lengthwise fashion in proximity to said first side;

a second adjusting means further comprising a pair of oppositely running drawstrings attached at their respective ends to said second garment side, a free end of said drawstring pairs in communication with an aperture defined by said garment along said second side at an approximate midpoint between said attached ends of said drawstring pairs, said second adjusting means reversibly gathering said garment front and said garment rear in a lengthwise fashion in proximity to said second side.

4. The garment according to claim 3, said garment further comprising a stiffening means in communication with said adjusting means, said stiffening means transmitting length changes from said sides of said garment to said front and said back of said garment.

* * * * *